US005945631A

United States Patent [19]

Henrikson et al.

[11] Patent Number: 5,945,631

[45] Date of Patent: Aug. 31, 1999

[54] IEEE 1394 ACTIVE WALL DISCONNECT AND AIRCRAFT QUALIFIED CABLE

[75] Inventors: Gregory K. Henrikson; Robert Troxel, both of Brea; Loi Ninh, Ranch, all of Calif.

[73] Assignees: Sony Corporation, Tokyo, Japan; Sony Electronics, Inc., Park Ridge, N.J.

[21] Appl. No.: 08/714,659

[22] Filed: Sep. 16, 1996

[51] Int. Cl.[6] ..... H01B 11/02

[52] U.S. Cl. ..... 174/34; 174/36; 174/102 R

[58] Field of Search ..... 174/34, 36, 102 R, 174/103, 104, 105 R, 107

[56] References Cited

U.S. PATENT DOCUMENTS

| | | | |
|---|---|---|---|
| 4,761,519 | 8/1988 | Olson et al. | 174/107 |
| 4,763,360 | 8/1988 | Daniels et al. | 455/3 |
| 4,853,555 | 8/1989 | Wheat | 307/9.1 |
| 4,924,037 | 5/1990 | Ainsworth et al. | 174/117 F |
| 5,133,034 | 7/1992 | Arroyo et al. | 385/107 |
| 5,216,202 | 6/1993 | Yoshida et al. | 174/36 |
| 5,216,204 | 6/1993 | Dudek et al. | 174/102 SC |
| 5,412,697 | 5/1995 | Van Brunt et al. | 375/360 |
| 5,796,042 | 8/1998 | Pope | 174/102 SP |

OTHER PUBLICATIONS

"1394 200 Mb/s PHYsical Layer Transceiver," IBM Microelectronics, Product Data Sheet and Application Notes, Version 1.4, Mar. 14, 1996.

"IEEE 1394–1995 Triple Cable Transceiver/Arbiter," Texas Instruments TSB21LV03, Product Review, Revision 0.99, Mar. 19, 1996.

"P1394 Standard for a High Performance Serial Bus," IEEE Standard 1394 (Draft), P1394 Draft 8.0v2, Jul. 7, 1995.

*Primary Examiner*—Kristine Kincaid
*Assistant Examiner*—William H. Mayo, III
*Attorney, Agent, or Firm*—Haverstock & Owens LLP

[57] ABSTRACT

An IEEE 1394 cable includes two individually shielded twisted data pairs of wires, carrying differential signals TPA and TPB, and two power conductors, carrying power signals VP and VG. The two twisted data pairs of wires are each individually shielded by a braided shield. The cable also includes an overall braided shield and a no smoke, no halogen, flame retardant jacket. Preferably, the cable has a length of 4.5 meters and includes 26 gauge wire for the two twisted data pairs. Longer, alternate embodiments of the cable incorporate heavier gauge wire for the two twisted data pairs. Preferably, the gauge wire used for the two power conductors is constant for the different lengths of cable. An active disconnect is used to provide an active repeater between IEEE 1394 cables. The active disconnect provides ports, into which cables are connected, and a physical connection including electronics necessary to form an active node on the IEEE 1394 serial bus. The active disconnect receives signals from one port and resynchronizes, encodes and transmits those signals out of the other ports. The active disconnect draws power from the power conductors of the IEEE 1394 cables which are coupled to it.

16 Claims, 16 Drawing Sheets

4.5 METER CABLE

IEEE 1394 ACTIVE WALL DISCONNECT AND AIRCRAFT QUALIFIED CABLE

FIELD OF THE INVENTION

The present invention relates to the field of network cabling and wall disconnects. More particularly, the present invention relates to the field of network cabling and wall disconnects for use with an IEEE 1394 serial bus network.

BACKGROUND OF THE INVENTION

The IEEE 1394 standard, "P1394 Standard For A High Performance Serial Bus," Draft 8.01v1, Jun. 16, 1995, is an international standard for implementing an inexpensive high-speed serial bus architecture which supports both asynchronous and isochronous format data transfers. The IEEE 1394 standard provides a high-speed serial bus for interconnecting digital devices thereby providing a universal I/O connection. The IEEE 1394 standard defines a digital interface for the applications thereby eliminating the need for an application to convert digital data to analog data before it is transmitted across the bus. Correspondingly, a receiving application will receive digital data from the bus, not analog data, and will therefore not be required to convert analog data to digital data. An 'application' as used herein will refer to either an application or a device driver.

The cable specified by the IEEE 1394 standard is very thin in size compared to many other cables, such as conventional co-axial cables, used to connect such devices. Devices can be added and removed from an IEEE 1394 bus while the bus is active. If a device is so added or removed the bus will then automatically reconfigure itself for transmitting data between the then existing nodes. A node is considered a logical entity with a unique address on the bus structure. Each node provides an identification ROM, a standardized set of control registers and its own address space.

A standard IEEE 1394 cable is illustrated in FIG. 1. An IEEE 1394 network using the standard IEEE 1394 cable 10 is a differential, copper wire network, which includes two differential pairs of wires 12 and 14, carrying the differential signals TPA and TPB, respectively. As shown in FIG. 1, the pairs of wires 12 and 14 are twisted together within the cable 10. The signals TPA and TPB are both low voltage, low current, bidirectional differential signals used to carry data bits or arbitration signals. The signals TPA and TPB have a maximum specified amplitude of 265 mVolts. The twisted pairs of wires 12 and 14 have a relatively high impedance, specified at 110 ohms, such that minimal power is needed to drive an adequate signal across the wires 12 and 14. The standard IEEE 1394 cable 10 also includes a pair of power signals VG and VP, carried on the wires 16 and 18, respectively. The wires 16 and 18 are also twisted together within the cable 10. The pair of power signals VP and VG provide the current needed by the physical layer of the serial bus to repeat signals. The wires 16 and 18 have a relatively low impedance and are specified to have a maximum power level of 60 watts.

The IEEE 1394 cable environment is a network of nodes connected by point-to-point links, including a port on each node's physical connection and the cable between them. The physical topology for the cable environment of an IEEE 1394 serial bus is a non-cyclic network of multiple ports, with finite branches. The primary restriction on the cable environment is that nodes must be connected together without forming any closed loops.

The IEEE 1394 cable connects ports together on different nodes. Each port includes terminators, transceivers and simple logic. A node can have multiple ports at its physical connection. The cable and ports act as bus repeaters between the nodes to simulate a single logical bus. Because each node must continuously repeat bus signals, the separate power VP wire 18 and ground VG wire 16, within the cable 10, enable the physical layer of each node to remain operational even when the local power at the node is turned off. The pair of power wires 16 and 18 can even be used to power an entire node if it has modest power requirements. The signal VG carried on the wire 16 is a grounded signal. The signal VP carried on the wire 18 is powered from local power of the active devices on the IEEE 1394 serial bus. Accordingly, at least one of the active devices must be powered by local power. Together, the signals VG and VP form a power signal which is used by the nodes.

The cable physical connection at each node includes one or more ports, arbitration logic, a resynchronizer and an encoder. Each of the ports provide the cable media interface into which the cable connector is connected. The standard IEEE 1394 cable connectors, used at both ends of the IEEE 1394 cable 10 provide six electrical contacts plus a shield. The six electrical contacts represent two contacts for each of the differential signals TPA and TPB, and a single contact each for the power signal VP and the ground signal VG. The arbitration logic provides access to the bus for the node. The resynchronizer takes received data-strobe encoded data bits and generates data bits synchronized to a local clock for use by the applications within the node. The encoder takes either data being transmitted by the node or data received by the resynchronizer, which is addressed to another node, and encodes it in data-strobe format for transmission across the IEEE 1394 serial bus. Using these components, the cable physical connection translates the physical point-to-point topology of the cable environment into a virtual broadcast bus, which is expected by higher layers of the system. This is accomplished by taking all data received on one port of the physical connection, resynchronizing the data to a local clock and repeating the data out of all of the other ports from the physical connection.

A maximum cable length of 4.5 meters is specified for an IEEE 1394 cable. The limitations of an IEEE 1394 serial bus are set by the timing requirement of the arbitration protocol for a fixed round-trip time for transmitted signals. The default timing is set after at most two bus resets, and it is adequate for 32 cable hops, each of 4.5 meters, for a total of 144 meters. This maximum cable length is not practical in some environments in which the distance between active devices is greater than 4.5 meters.

A lack of existing IEEE 1394 repeaters means that IEEE 1394 serial busses must be constructed only in environments which lend themselves to the placement of devices within 4.5 meters of each other. In some environments, devices must, by necessity, be separated by more than 4.5 meters. Without an active repeater or longer cables, an IEEE 1394 serial bus is not practical for such configurations.

The IEEE 1394 cable was designed to comply with the Federal Communications Commission (FCC) regulations for Class B consumer electronics devices. However, the standard IEEE 1394 cable does not comply with other federal regulations, set by the Federal Aviation Association (FAA) for equipment which is used on commercial aircraft. The FAA has strict requirements relating to adequate shielding of electromagnetic interference (EMI) radiation and flammability of the cable. The PVC jacket specified for use on an IEEE 1394 standard cable is highly flammable and produces toxic gasses when burned. The IEEE 1394 standard cable also emits a greater amount of EMI radiation than is allowed under the FAA requirements. For these reasons, a standard IEEE 1394 cable cannot be used on commercial aircraft.

What is needed is a cable which is suitable for use between IEEE 1394 devices and which also complies with the FAA regulations for use on commercial aircraft. What is further needed is an apparatus which can be used as an active repeater between IEEE 1394 cables. What is still further needed is an apparatus which can be used as an active repeater between IEEE 1394 cables and which is suitable for use on commercial aircraft.

SUMMARY OF THE INVENTION

An IEEE 1394 cable includes two individually shielded twisted data pairs of wires, carrying differential signals TPA and TPB, and two power conductors, carrying power signals VP and VG. The two twisted data pairs of wires are each individually shielded by a braided shield. The cable also includes an overall braided shield and a no smoke, no halogen, flame retardant jacket. Preferably, the cable has a length of 4.5 meters and includes 26 gauge wire for the two twisted data pairs. Longer, alternate embodiments of the cable incorporate heavier gauge wire for the two twisted data pairs. Preferably, the gauge wire used for the two power conductors is constant for the different lengths of cable. An active disconnect is used to provide an active repeater between IEEE 1394 cables. The active disconnect provides ports, into which cables are connected, and a physical connection including electronics necessary to form an active node on the IEEE 1394 serial bus. The active disconnect receives signals from one port and resynchronizes, encodes and transmits those signals out of the other ports. The active disconnect draws power from the power conductors of the IEEE 1394 cables which are coupled to it.

DETAILED DESCRIPTION OF THE PREFERRED EMBODIMENT

Figure 1:
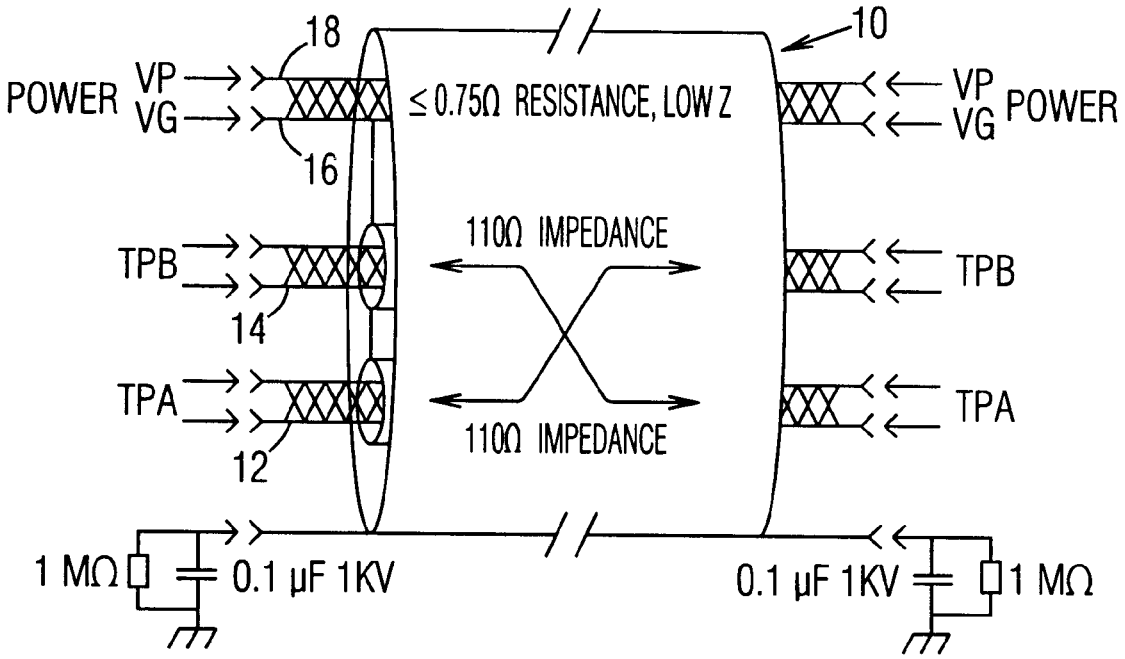
Fig. 1 (Prior Art)
FIG. 1 illustrates a standard IEEE 1394 cable of the prior art.
Figure 2:
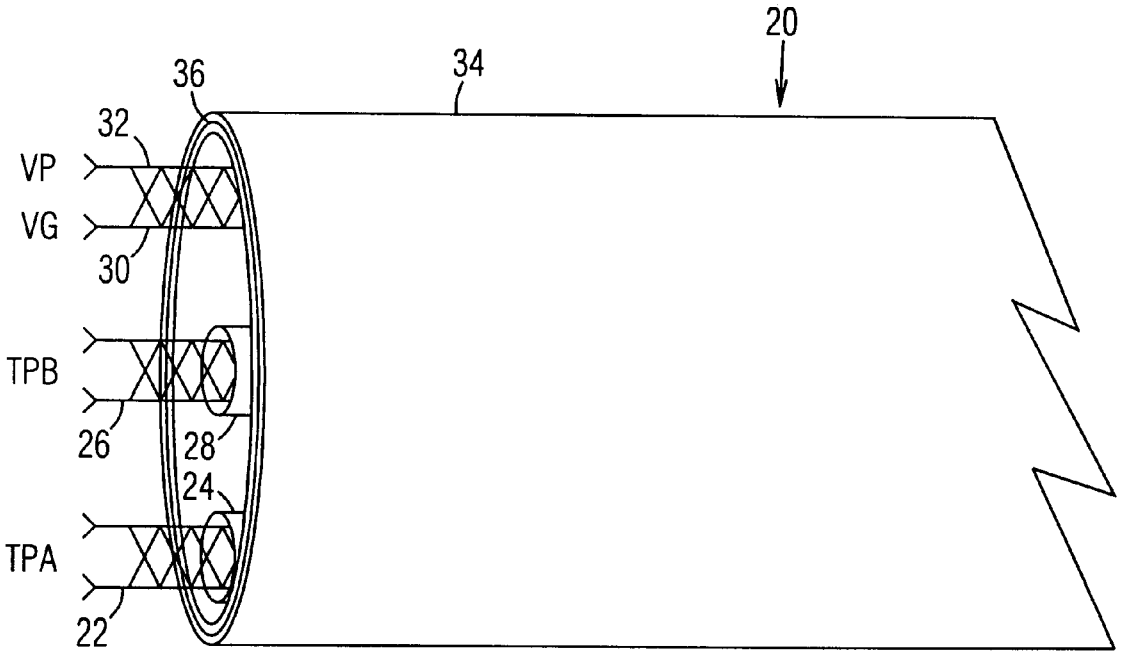
FIG. 2 illustrates a cross section of a 4.5 meter IEEE 1394 cable according to the present invention.

A cross section of an IEEE 1394 cable 20 according to the present invention is illustrated in FIG. 2. This cable 20 consists of two individually shielded twisted data pairs of wires 22 and 26 and two conductors 30 and 32. The cable 20 also includes an overall braided shield and a no smoke, no halogen, flame retardant jacket to meet FAA requirements for commercial aircraft. The cable 20 includes a first twisted pair of wires 22 for carrying the differential signal TPA, a second twisted pair of wires 26 for carrying the differential signal TPB, a wire 30 for carrying the ground signal VG and a wire 32 for carrying the power signal VP. The twisted pair of wires 22 are encased within a first braided shield 24. The twisted pair of wires 26 are encased within a second braided shield 28. An overall braided shield 36 is formed around the shields 24 and 28 and the wires 30 and 32. A flame retardant jacket 34 is then provided around the overall shield 36. This no-smoke, no-halogen, flame retardant jacket 34 is provided in order to comply with the Federal Aviation Administration Regulation regarding the required fire protection of systems, in order to use this cable on commercial aircraft. 14 C.F.R. § 25.869 (1994).

Embodiments of the IEEE 1394 cable of the present invention have been designed to have different lengths. The cable 20 of the preferred embodiment has a length of 4.5 meters to comply with the IEEE 1394 standard specification. However, alternate embodiments of the cable of the present invention have longer lengths for spanning distances greater than 4.5 meters. The IEEE 1394 cable of the present invention is preferably, for use on board a commercial aircraft to couple and form an IEEE 1394 serial bus between devices which are part of an in-flight entertainment system, as taught in U.S. patent application Ser. No. 08/714,772, filed on Sep. 16, 1996, and entitled "Combined Digital Audio/Video On Demand And Broadcast Distribution System," which is hereby incorporated by reference. Because of the constraints of this system and of the limited space available within the aircraft, a cable having a length greater than 4.5 meters is necessary for coupling between some of the devices within the system. As stated above, the standard IEEE 1394 cable is also not appropriate for use on a commercial aircraft because of its high EMI radiation emissions and flammability. While the preferred use of the cable of the present invention is within an aircraft, it should however be apparent that the cables according to the present invention can be used in other environments in which the standard IEEE 1394 cable is also not appropriate, including other transportation vehicles such as trains, busses, ferries and cruise ships. Specifically, the cable of the present invention is suitable for use in any environment where low EMI emissions and flame retardation is important, such as in military use or within plenums. The cable of the present invention is also suitable for any other environment, such as hospitals, where low EMI emissions and low toxic smoke content is important.

In order to simulate the other requirements of the IEEE 1394 specification, the longer length cables of the alternate embodiments of the present invention incorporate heavier gauge wire for the twisted pairs of wires used to carry the differential signals TPA and TPB. The heavier gauge wire ensures that the strength of those signals is not degraded and that proper attenuation is maintained over the entire length of the longer cable. The other materials, characteristics and properties of the cable are preferably identical between the cables of different lengths. Specifically, the same gauge wire is used within the different lengths of cables, for the conductors which carry the power VP and ground VG signals, in order to minimize the diameter of the cable.

The cable 20 of the preferred embodiment, illustrated in FIG. 2, has a length of 4.5 meters. The twisted pairs of wires 22 and 26 are each preferably 26 AWG (American Wire Gauge) solid tinned copper wires, each with its own separate insulation. Alternatively, the twisted pairs of wires 22 and 26 are 26 gauge silver plated copper wires or stranded wires to enhance the flexibility and ease of service of the wires. The twisted pairs of wires 22 and 26 are each individually shielded by a braided shield 24 and 28, respectively. The braided shields 24 and 28 are preferably constructed of aluminum/polyester film material, where such polyester film is sold under the trademark MYLAR, with PTFE tape used for shield isolation. Alternatively, any appropriate non-conducting, dielectric insulating tape can be used. The braided shields 24 and 28 are preferably +26 drain, +65% braid, #40 shields. The conductors 30 and 32, used to carry the signals VG and VP, are preferably 20 gauge stranded tinned copper wires. The outer or overall braided shield 36 preferably is constructed of an aluminum/polyester film, where such polyester film is sold under the trademark MYLAR, 38 gauge tinned copper braided shield. The jacket 34 is preferably constructed of a flame retardant polyurethane material having an oxygen index of 32 min.020".

The twisted pairs of wires 22 and 26 preferably have a differential impedance of 110 ohms, per the IEEE 1394 specification. The twisted pairs of wires 22 and 26 both have attenuations of 2.3 decibels per 4.5 meters at 100 MegaHertz (MHz), 3.2 decibels per 4.5 meters at 200 (MHz) and 5.8 decibels per 4.5 meters at 400 (MHz).

EXAMPLE 1

An IEEE 1394 cable 20 of the present invention, having a length equal to 4.5 meters was tested for EMI emission levels, per the FAA requirements. The results of the emission tests are attached as FIGS. 8A–12B. The IEEE 1394 cable 20 of the present invention was tested for EMI emission levels while it was connected between two devices and carrying signals between the devices. These signals were sent across the IEEE 1394 cable 20 at a frequency equal to 200 megabytes per second. Per the FAA requirements, both conductive and radiated emissions were measured. These emissions were measured in different configurations and for a range of frequencies using a spectrum analyzer.

Figure 8A:
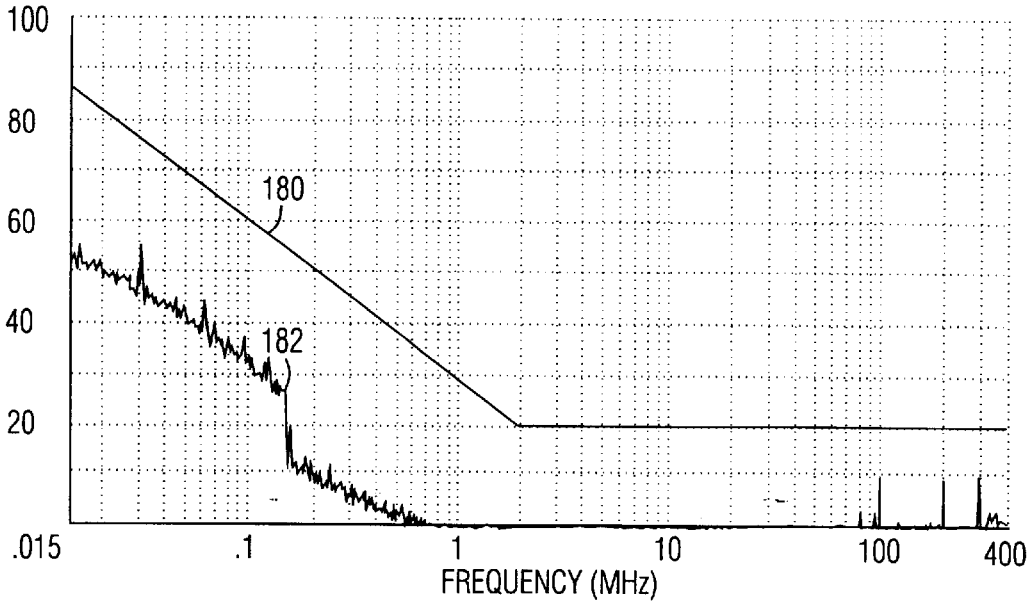
FIG. 8A illustrates a plot of narrowband conductive emissions of the cable of the present invention over a frequency range of 0.015 MHz to 400 MHz.
Figure 8B:
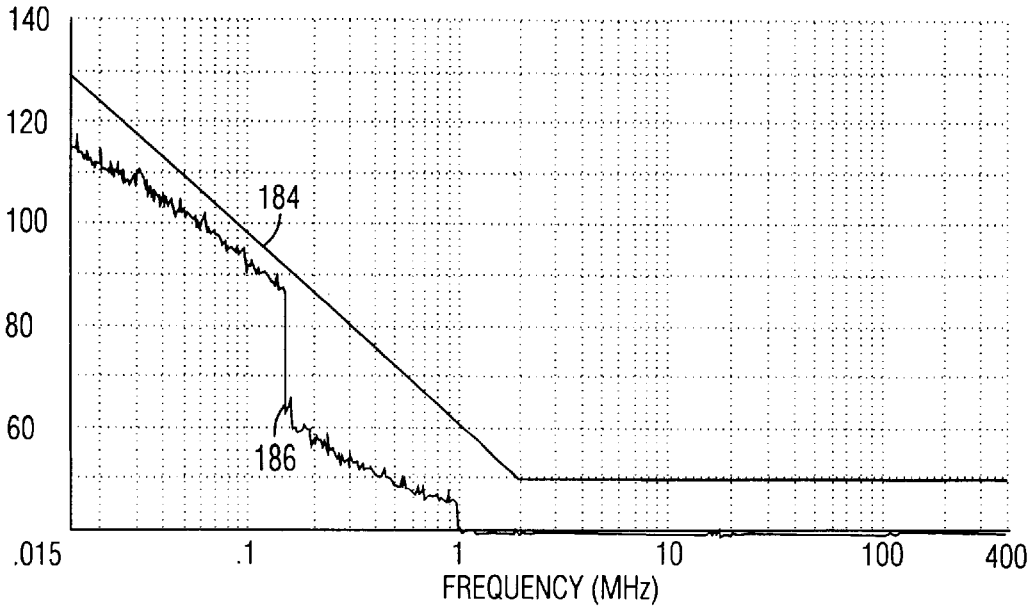
FIG. 8B illustrates a plot of broadband conductive emissions of the cable of the present invention over a frequency range of 0.015 MHz to 400 MHz.

To measure conductive emissions of the IEEE 1394 cable of the present invention, a current probe was attached around the cable while signals were transmitted across the cable. A plot 182 of narrowband conductive emissions of the cable, over a range of frequencies from 0.015 MHz to 400 MHz, is illustrated in FIG. 8A. In each of the illustrated plots of FIGS. 8A–12B, the emission level is shown on the vertical axis and the frequency range is shown on the horizontal axis. Also, in each of the illustrated plots of FIGS. 8A–12B, a line is drawn to illustrate the maximum FAA allowed emission levels. Accordingly, if the measured emission level rises above the maximum allowed level line, then the cable does not meet FAA requirements and cannot be used in commercial aircraft. Correspondingly, if the measured emission level does not rise above the maximum allowed level line, then the cable does meet FAA requirements and is suitable of use on commercial aircraft. In FIG. 8A, this maximum allowed level line is shown as the line 180. A plot 186 of broadband conductive emissions of the cable, over a range of frequencies from 0.015 MHz to 400 MHz, is illustrated in FIG. 8B. The maximum allowed level line 184 for this configuration and frequency range is also illustrated in FIG. 8B.

Figure 9A:
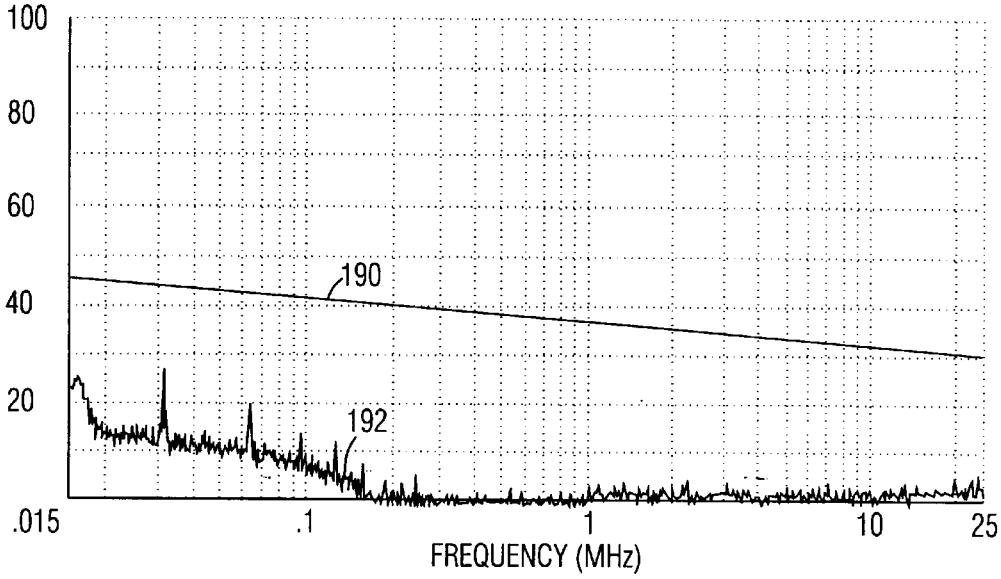
FIG. 9A illustrates a plot of narrowband radiated emissions of the cable of the present invention over a frequency range of 0.015 MHz to 25 MHz.
Figure 9B:
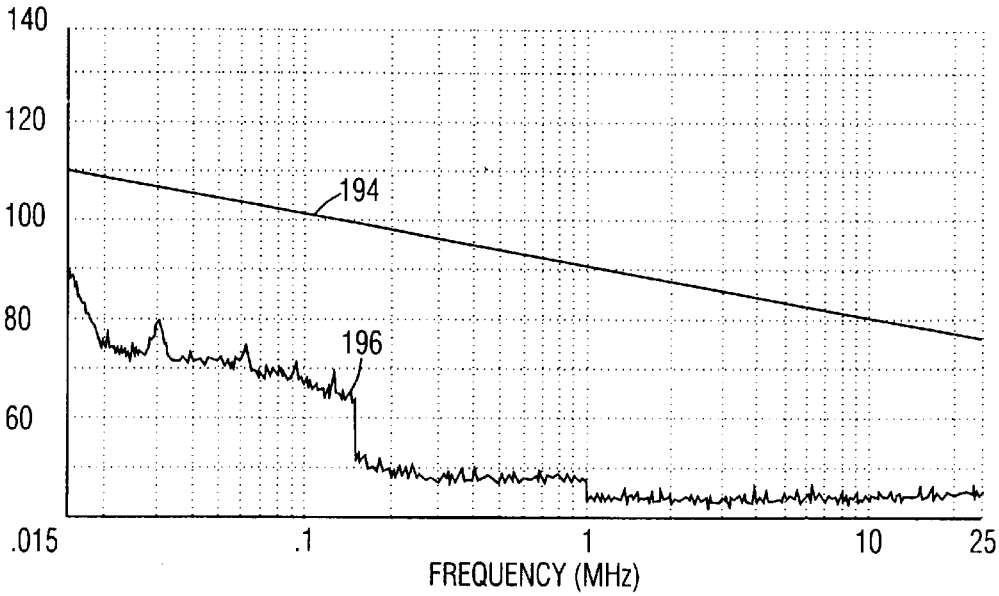
FIG. 9B illustrates a plot of broadband radiated emissions of the cable of the present invention over a frequency range of 0.015 MHz to 25 MHz.

To measure radiated emissions of the IEEE 1394 cable of the present invention, an antenna connected to the spectrum analyzer was setup at a distance of one meter from the cable to measure the EMI emissions from the cable, as the cable was carrying signals. A plot 192 of narrowband radiated emissions of the cable, over a range of frequencies from 0.015 MHz to 25 MHz, is illustrated in FIG. 9A. The maximum allowed level line 190 for this configuration and frequency range is also illustrated. A plot 196 of broadband radiated emissions of the cable, over a range of frequencies from 0.015 MHz to 25 MHz, is illustrated in FIG. 9B. The maximum allowed level line 194 for this frequency range is also illustrated.

Figure 10A:
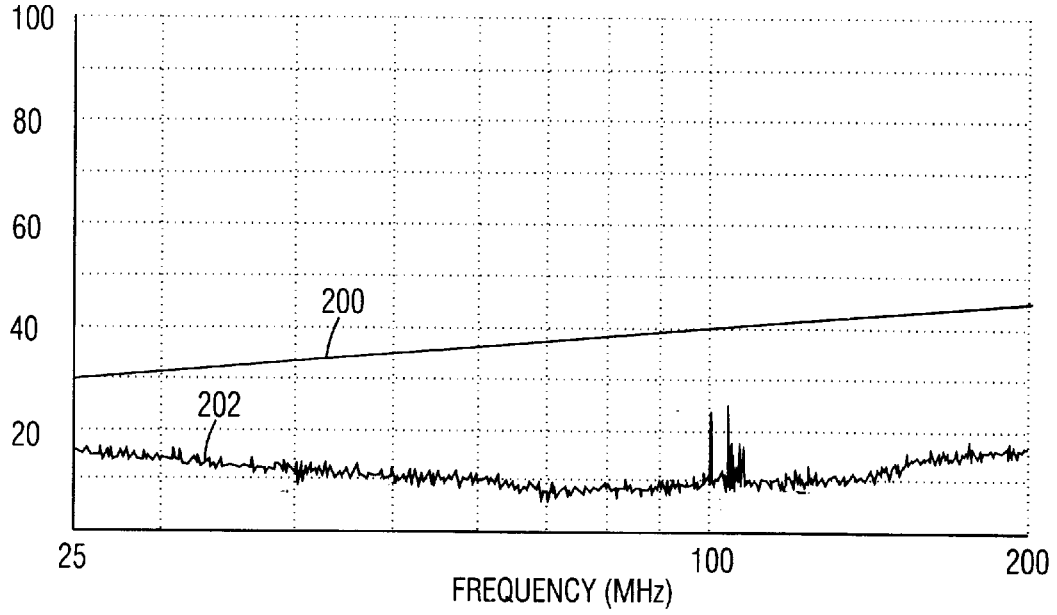
FIG. 10A illustrates a plot of narrowband radiated emissions of the cable of the present invention, with the measuring antenna in a vertical orientation, over a range of frequencies from 25 MHz to 200 MHz.
Figure 10B:
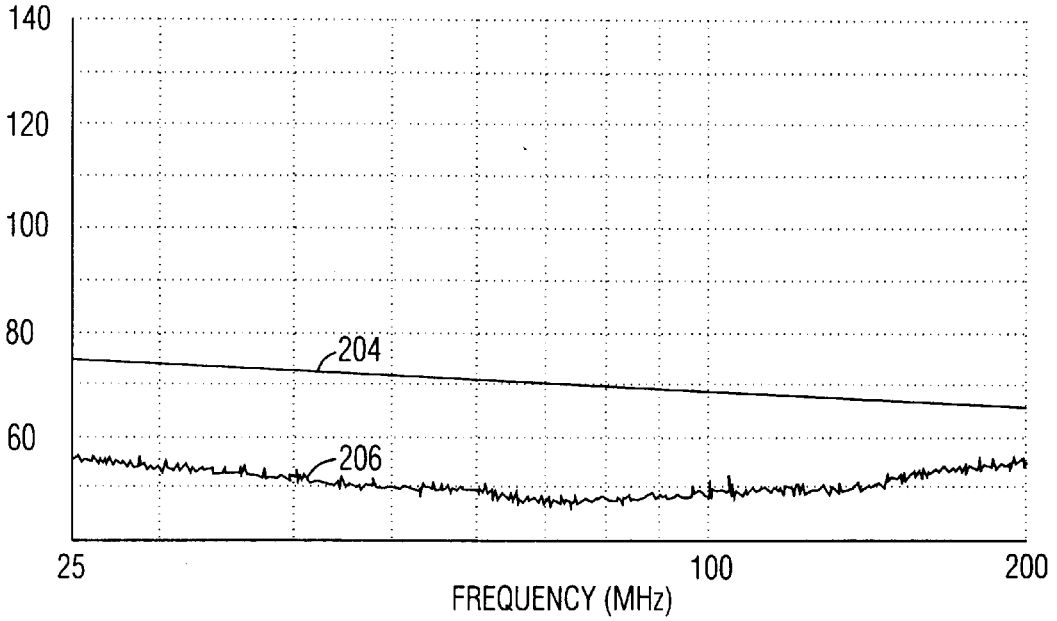
FIG. 10B illustrates a plot of broadband radiated emissions of the cable of the present invention, with the measuring antenna in a vertical orientation, over a range of frequencies from 25 MHz to 200 MHz.
Figure 11A:
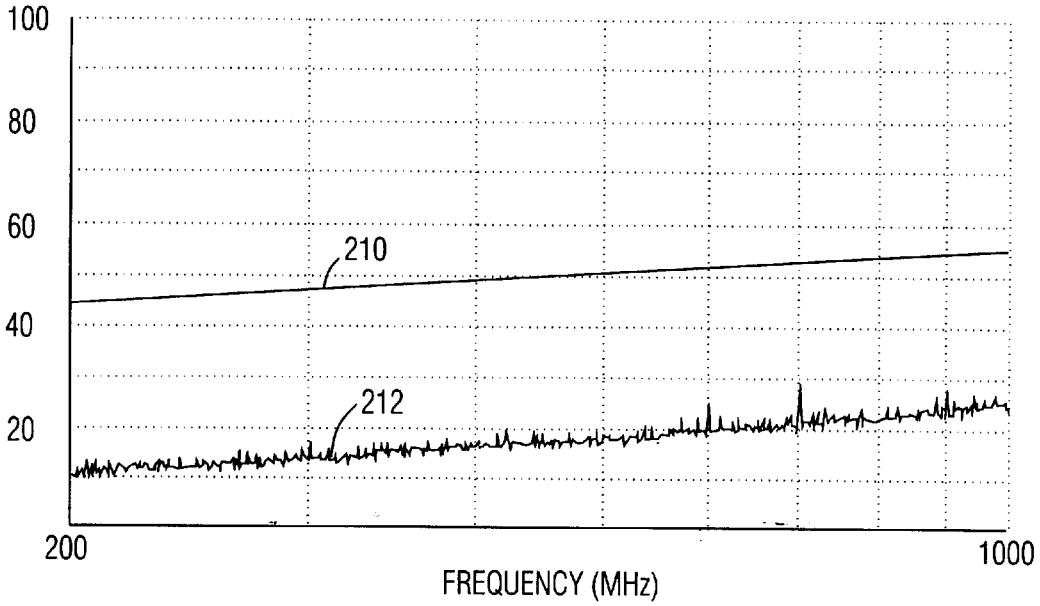
FIG. 11A illustrates a plot of narrowband radiated emissions of the cable of the present invention, with the measuring antenna in a vertical orientation, over a range of frequencies from 200 MHz to 1000 MHz.
Figure 11B:
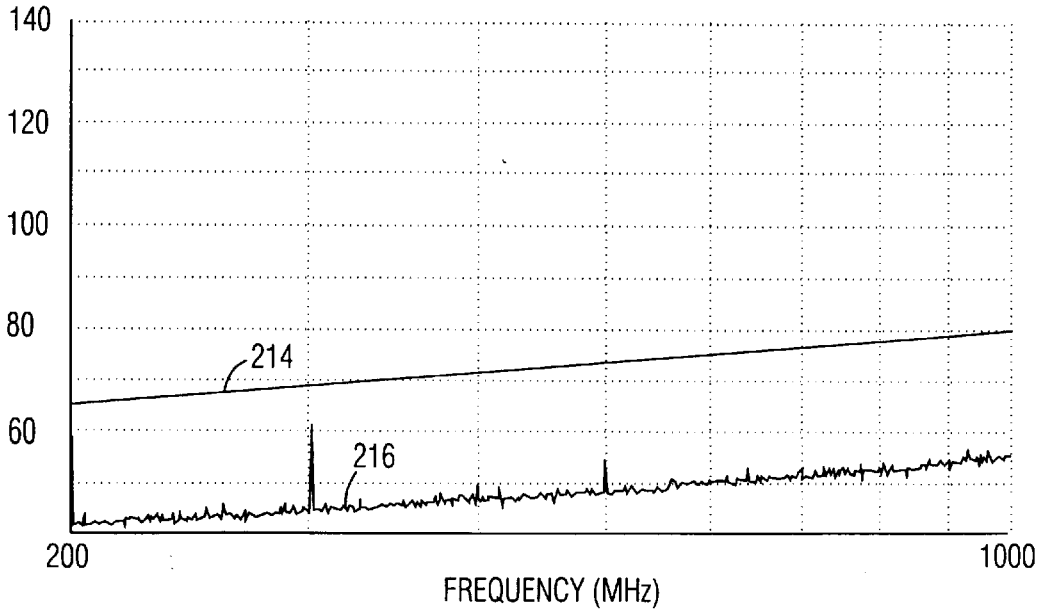
FIG. 11B illustrates a plot of broadband radiated emissions of the cable of the present invention, with the measuring antenna in a vertical orientation, over a range of frequencies from 200 MHz to 1000 MHz.

A plot 202 of narrowband radiated emissions of the cable 20 of the present invention, with the measuring antenna in a vertical orientation, over a range of frequencies from 25 MHz to 200 MHz, is illustrated in FIG. 10A. The maximum allowed level line 200 for this configuration and frequency range is also illustrated. A plot 212 for the same configuration of FIG. 10A, over a range of frequencies from 200 MHz to 1000 MHz, is illustrated in FIG. 11A. The maximum allowed level line 210 for this configuration and frequency range is also illustrated. A plot 206 of broadband radiated emissions of the cable, with the measuring antenna in a vertical orientation, over a range of frequencies from 25 MHz to 200 MHz, is illustrated in FIG. 10B. The maximum allowed level line 204 for this configuration and frequency range is also illustrated. A plot 216 for the same configuration of FIG. 10B, over a range of frequencies from 200 MHz to 1000 MHz, is illustrated in FIG. 11B. The maximum allowed level line 214 for this configuration and frequency range is also illustrated.

Figure 12A:
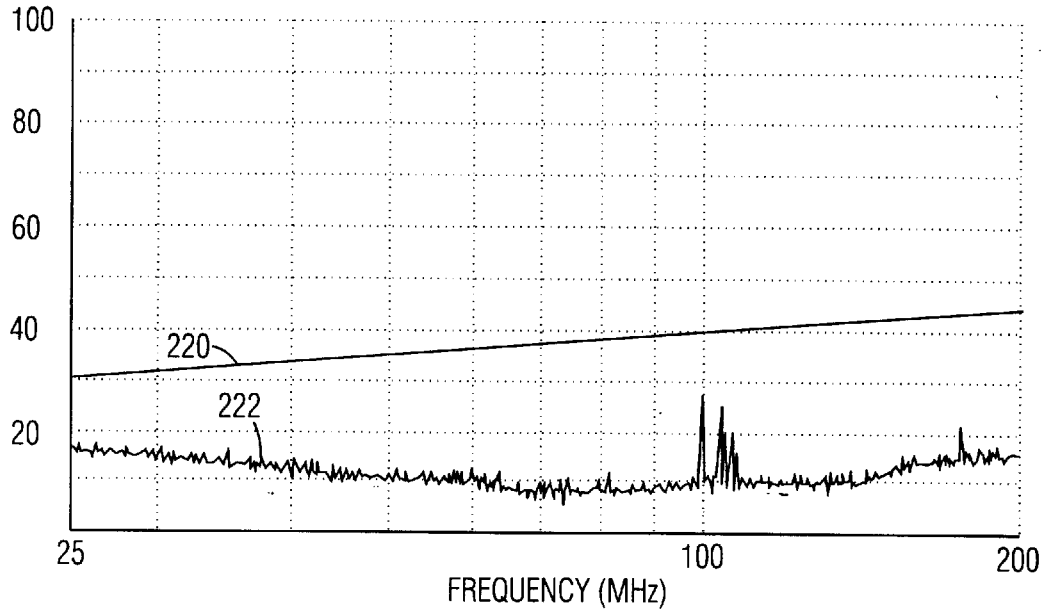
FIG. 12A illustrates a plot of narrowband radiated emissions of the cable of the present invention, with the measuring antenna in a horizontal orientation, over a range of frequencies from 25 MHz to 200 MHz.
Figure 12B:
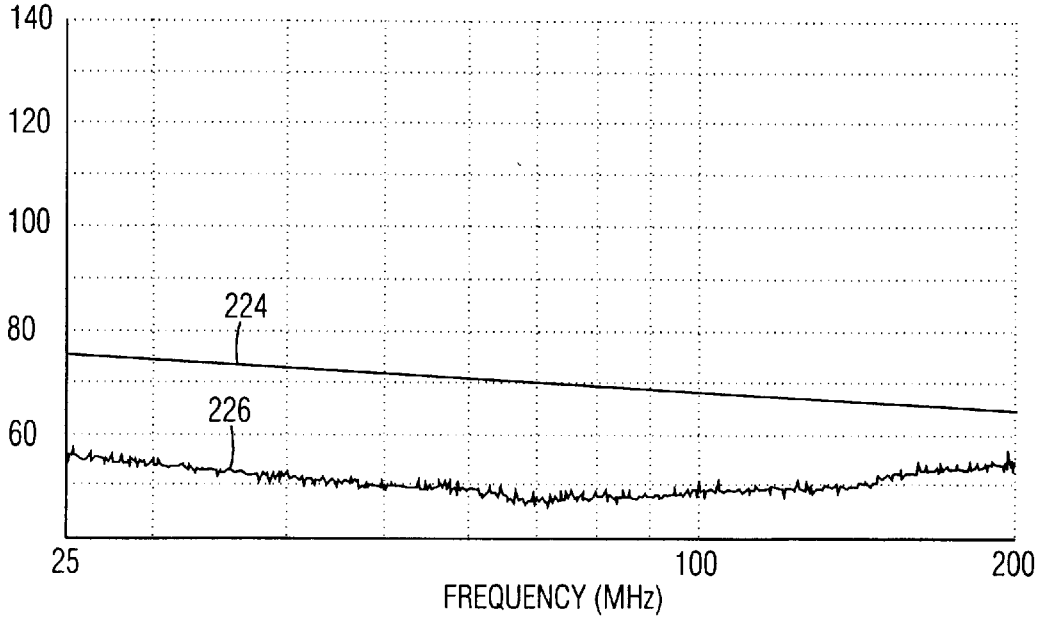
FIG. 12B illustrates a plot of broadband radiated emissions of the cable of the present invention, with the measuring antenna in a horizontal orientation, over a range of frequencies from 25 MHz to 200 MHz.

A plot 222 of narrowband radiated emissions of the cable 20 of the present invention, with the measuring antenna in a horizontal orientation, over a range of frequencies from 25 MHz to 200 MHz, is illustrated in FIG. 12A. The maximum allowed level line 220 for this configuration and frequency range is also illustrated. A plot 226 of broadband radiated emissions of the cable, with the measuring antenna in a horizontal orientation, over a range of frequencies from 25 MHz to 200 MHz, is illustrated in FIG. 12B. The maximum allowed level line 224 for this configuration and frequency range is also illustrated.

In none of the tests of the cable 20 of the present invention, illustrated in FIGS. 8A–12B, does the emission level of the cable exceed the maximum allowed level, per the FAA requirements, at any frequency. Accordingly, the cable 20 of the present invention is suitable for use on commercial aircraft.

Figure 3:
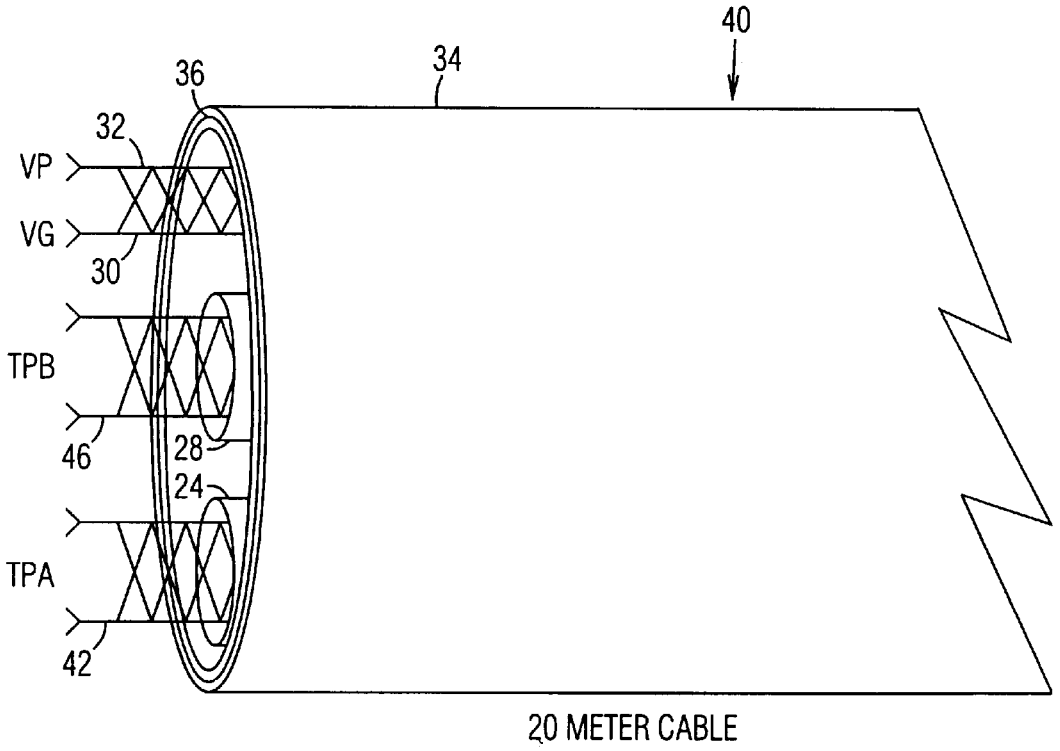
FIG. 3 illustrates a cross section of a 20 meter IEEE 1394 cable according to the present invention.

A cable 40 of an alternate embodiment of the present invention, having a length of 20 meters, is illustrated in FIG. 3. The only differences, besides the length, between the cable 40 and the cable 20, is that the twisted pairs of wires 42 and 46 are 18 gauge silver tinned copper wires and correspondingly, the diameter of the cable 40 is larger than the diameter of the cable 20. The twisted pairs of wires 42 and 46 alternatively are 18 gauge silver plated copper wires or stranded wires. The braided shields 24 and 28 preferably have the same properties as described above with regards to the cable 20. The conductors 30 and 32 are preferably the same gauge and type of wire used in the cable 20 and described above. The overall braided shield 36 and the flame retardant jacket 34 are also preferably the same material used in the cable 20 and described above. By not increasing the gauge of the conductors 30 and 32 for the longer cable, the diameter of the cable 40 is kept to a minimum. The performance characteristics of the cable 40 match the performance characteristics of the cable 20 and comply with the signal levels and timing requirements of the IEEE 1394 specification over the increased distance, because of the larger gauge wire used for the twisted pairs of wires 42 and 46.

Figure 4:
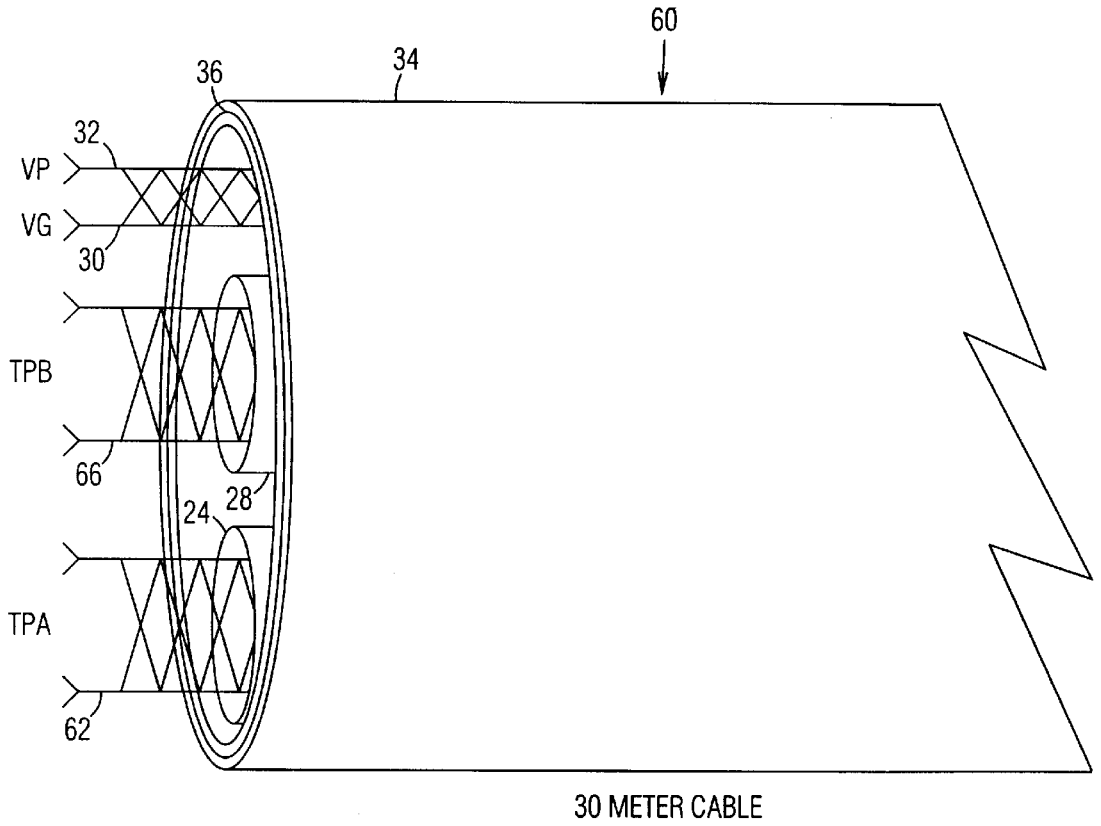
FIG. 4 illustrates a cross section of a 30 meter IEEE 1394 cable according to the present invention.

A cable 60 of an alternate embodiment of the present invention, having a length of 30 meters, is illustrated in FIG. 4. The only differences, besides the length, between the cable 60 and the cable 20, is that the twisted pairs of wires 62 and 66 are 16 gauge silver tinned copper wires and correspondingly, the diameter of the cable 60 is larger. The twisted pairs of wires 62 and 66 alternatively are 16 gauge silver plated copper wires or stranded wires to enhance the flexibility and ease of service of the wires. The braided shields 24 and 28 preferably have the same properties as the cables 20 and 40, described above. The conductors 30 and 32 are preferably the same gauge and type of wire used in the cables 20 and 40 and described above. The overall braided shield 36 and the flame retardant jacket 34 are also preferably the same material used in the cables 20 and 40 and described above. By not increasing the gauge of the conductors 30 and 32 for the longer cable, the diameter of the cable 60 is kept to a minimum. The performance characteristics of the cable 60 match the performance characteristics of the cable 20 and comply with the signal level and timing requirements of the IEEE 1394 specification over the increased distance, because of the larger gauge wire used for the twisted pairs of wires 62 and 66.

The use of larger gauge wire for the twisted pairs of wires, which carry the differential signals TPA and TPB, allow the lengths of the cables 40 and 60 to be extended beyond the specified 4.5 meters and still simulate the specifications required by the IEEE 1394 standard. The longer cables 40 and 60 are used to connect and send communications between IEEE 1394 devices which are a distance greater than 4.5 meters apart. It should be apparent to those skilled in the art that other lengths of cables can be built according to the teachings of the present invention.

The inclusion of the aluminum/polyester film, where such polyester film is sold under the trademark MYLAR, braided shields 24 and 28 and the aluminum/polyester film, where such polyester film is sold under the trademark MYLAR, overall braided shield 36 improves the internal shielding of the cable and serves to reduce the EMI radiation emitted from the cable of the present invention to levels acceptable by the FAA for use on commercial aircraft. The no smoke, no halogen, flame retardant polyurethane jacket 34 reduces the flammability and toxic emissions of the cable of the present invention to a level acceptable by the FAA for use on commercial aircraft. Accordingly, the IEEE 1394 cable of the present invention is within FAA guidelines for use on commercial aircraft because of its low EMI radiation and flammability characteristics. The IEEE 1394 cable of the present invention also complies with the specifications required by the IEEE 1394 standard even across the longer lengths.

Figure 5:
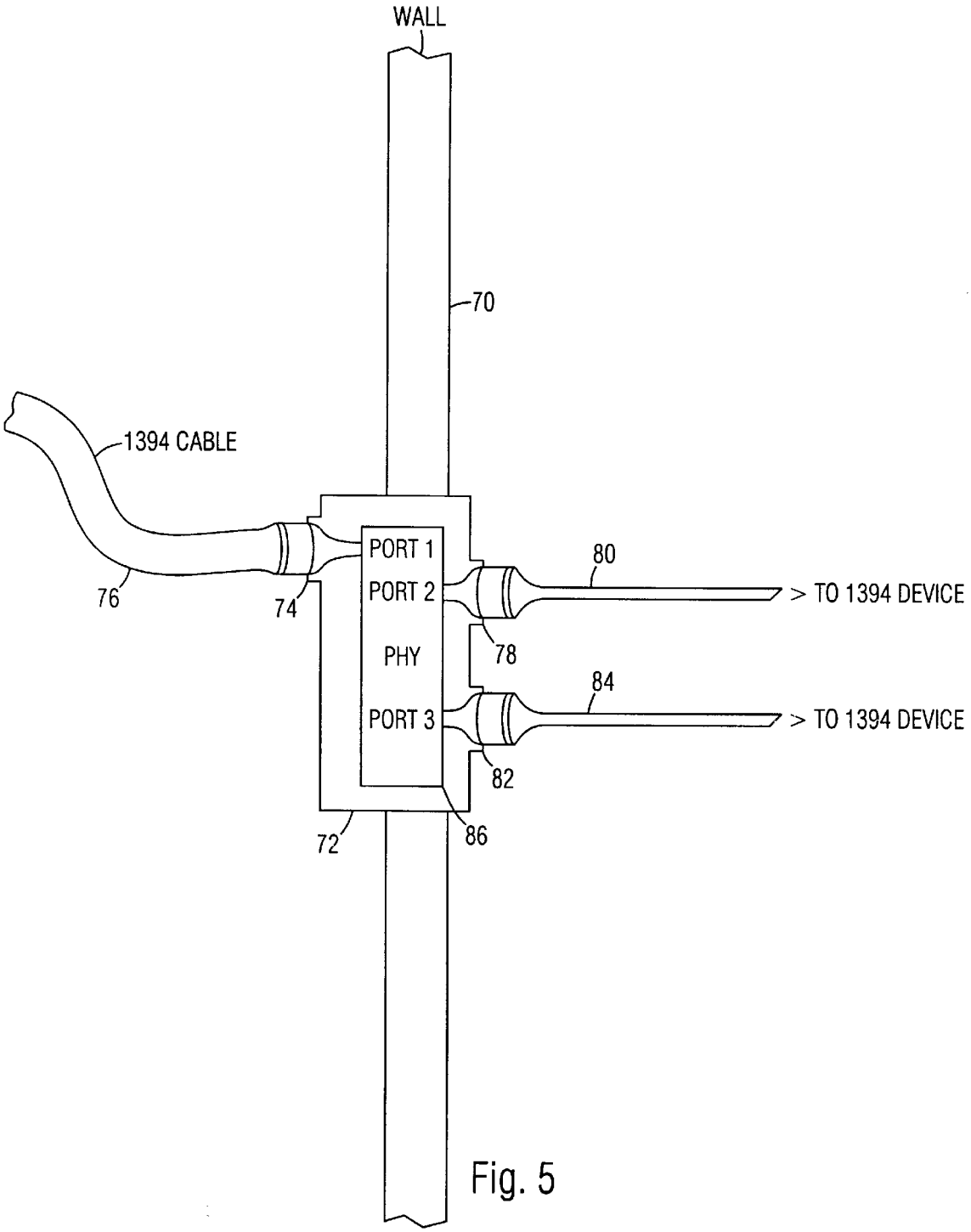
FIG. 5 illustrates a cross section of a three-port IEEE 1394 active disconnect according to the present invention.
Figure 6A:
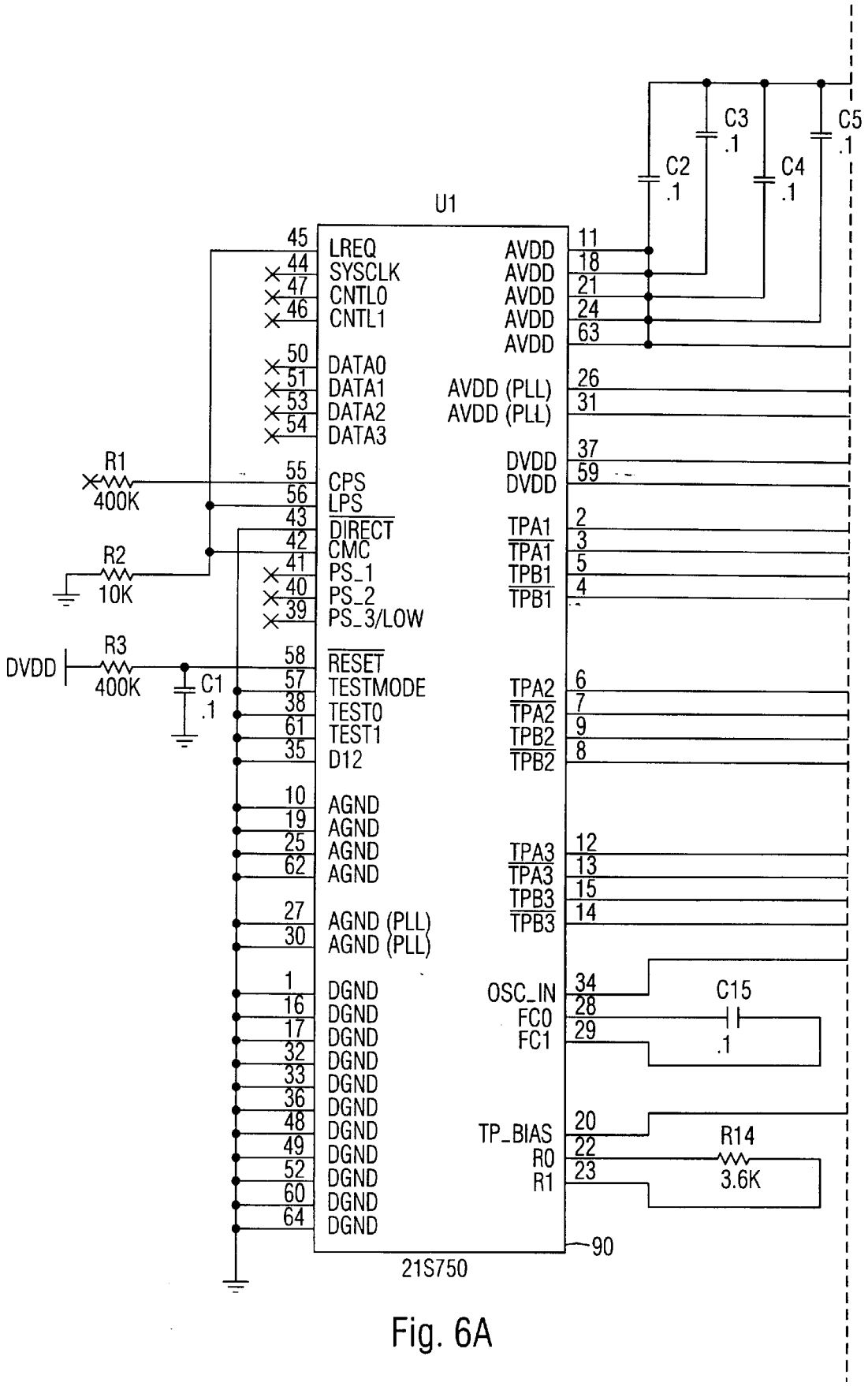
FIG. 6 illustrates a detailed block diagram of the components of a physical connection circuit within the active wall disconnect according to the present invention.
Figure 6B:
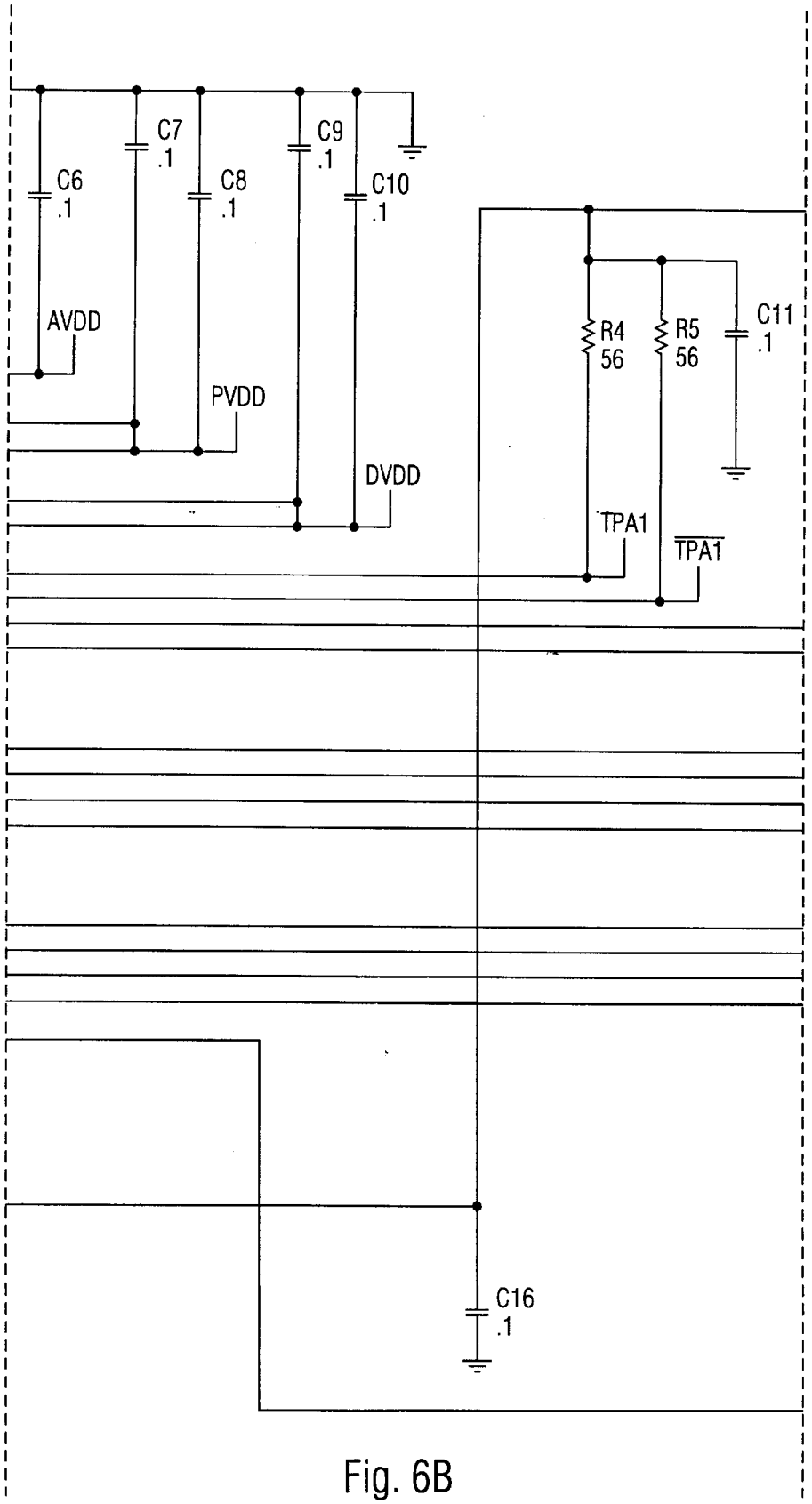
Figure 6C:
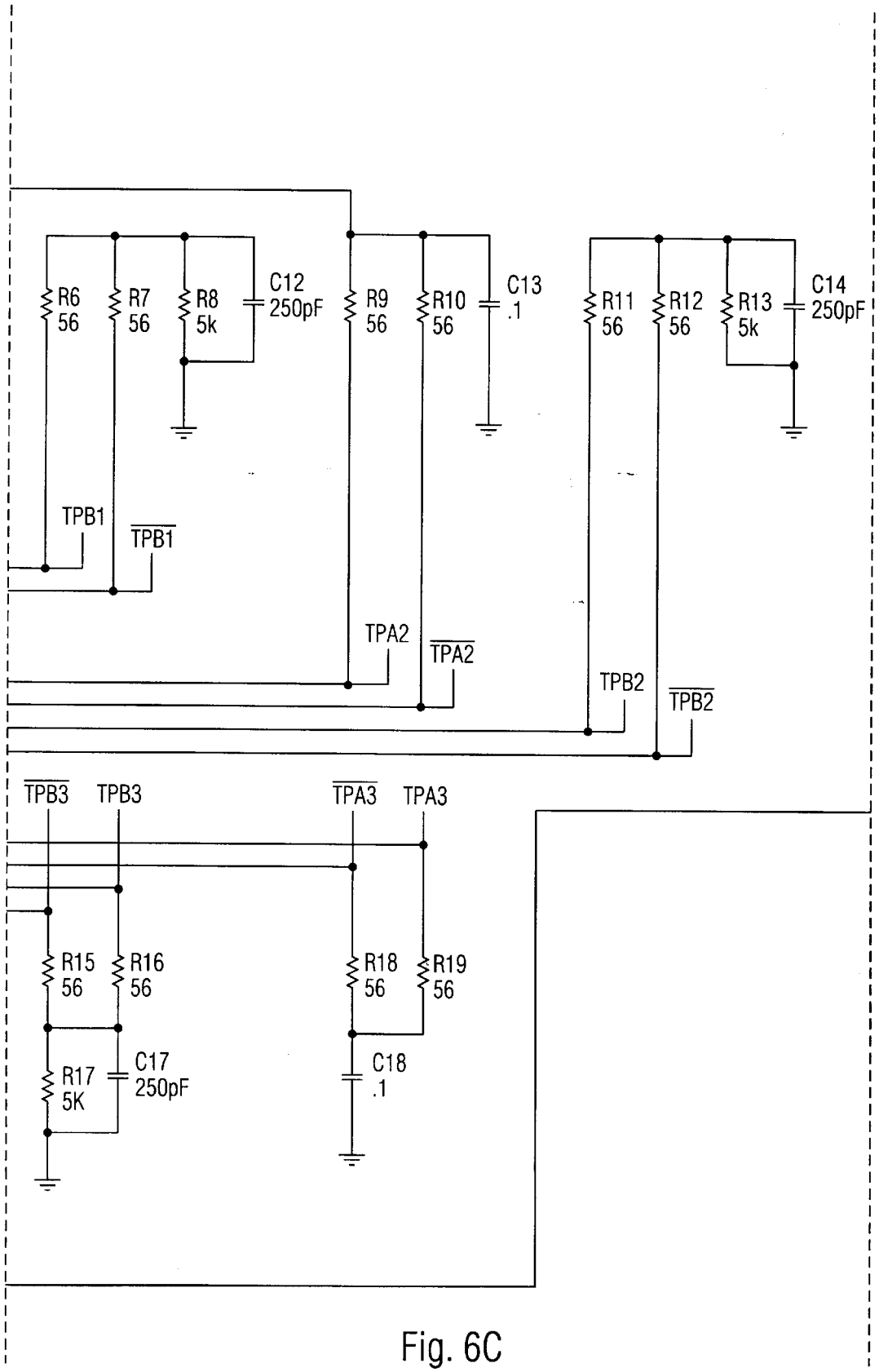
Figure 6D:
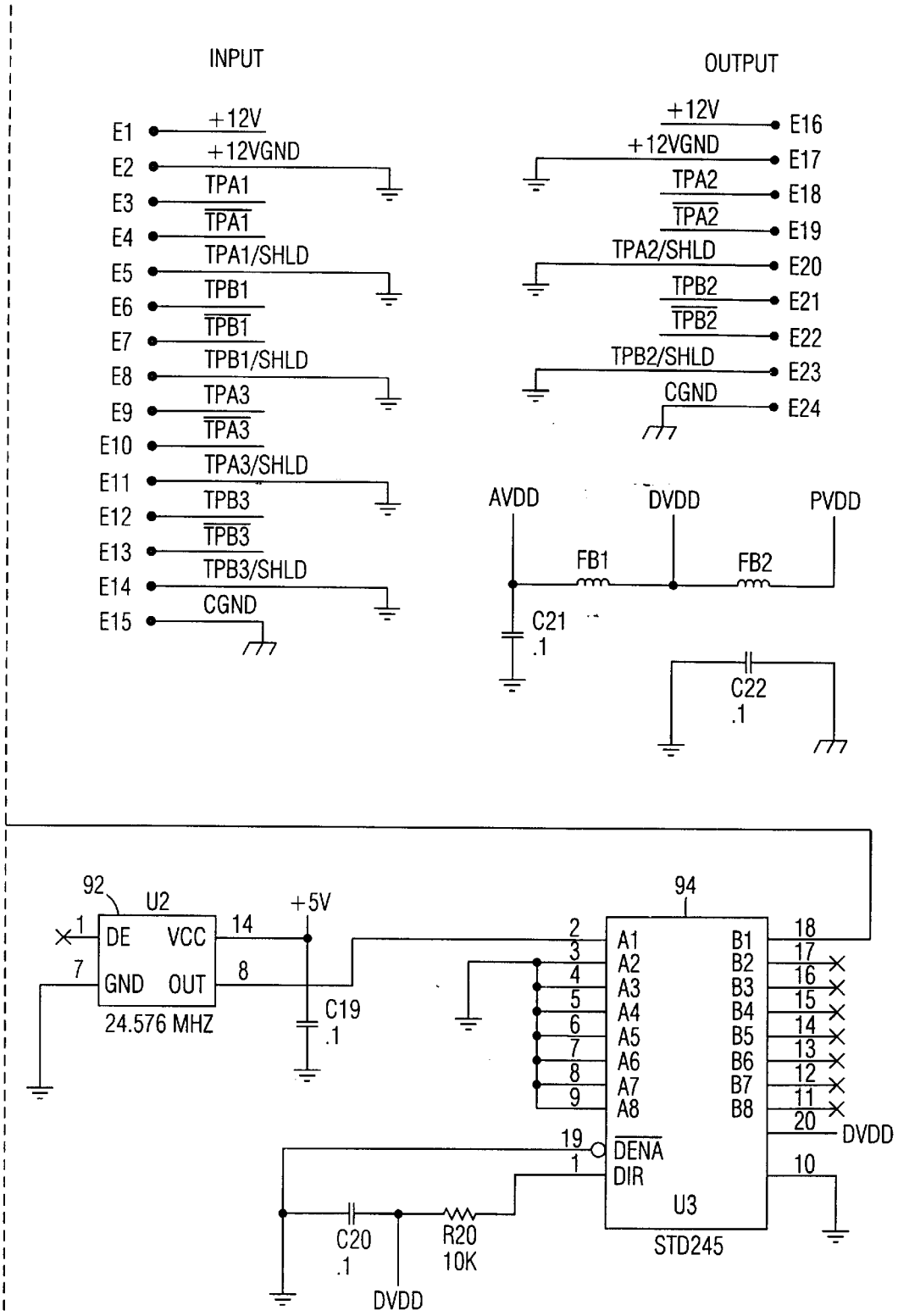

A cross-sectional view of an IEEE 1394 active disconnect 72 mounted within a wall 70 is illustrated in FIG. 5. It should be understood that the active disconnect 72 of the present invention can be mounted through a wall, a floor or any other aircraft bulkhead. When mounted within such a bulkhead, the active disconnect 72 is mounted between the overhead area of the aircraft and the cabin area of the aircraft. It should be understood that as used in this document, the term behind the wall 70, refers to positions within the overhead area of the aircraft, and the term in front of the wall 70, refers to positions within the cabin area of the aircraft. The active disconnect 72 includes electronic circuitry necessary to form an active node on the IEEE 1394 serial bus within the physical connection 86. The active disconnect 72 includes a port 74, behind the wall 70, into which an IEEE 1394 cable 76 from a connected IEEE 1394 device is inserted. The port 74 is coupled to the physical connection 86. The active disconnect 72 includes a port 78 and a port 82, in front of the wall, into which IEEE 1394 cables 80 and 84 are respectively coupled for connection to other IEEE 1394 devices.

The active disconnect 72 has an address on the IEEE 1394 serial bus and responds to communications received on any of the ports 74, 78 and 82, as an IEEE 1394 node. The physical connection 86 receives signals which come in through any one of the ports 74, 78 and 82. The signals received through one of the ports 74, 78 or 82 are then resynchronized, encoded in data-strobe format and transmitted through the two non-receiving ports 74, 78 or 82. The active disconnect 72 draws power for its operation from the power signal VP, which is referenced to the ground signal VG. Both of the signals VP and VG are carried on the IEEE 1394 cables 76, 80 and 84. As an example, if signals are received through the port 24, from the cable 76, the physical connection 86 will resynchronize, encode in data-strobe format and then transmit the signals through the ports 78 and 82 to the devices coupled to the cables 80 and 84. While the active disconnect 72 does not have any applications running, as do other nodes on the IEEE 1394 serial bus, it does perform the other functions of a node, such as receiving and transmitting signals to other nodes on the IEEE 1394 serial bus through its active ports.

The preferred embodiment of the active disconnect 72 of the present invention is for use within an aircraft to provide an IEEE 1394 connection between components of the in-flight entertainment system coupled to the IEEE 1394 serial bus. While the ports 72, 78 and 82 can have any IEEE 1394 cable coupled to them, preferably the port 74, which is positioned behind the wall 70, will have either the 20 meter or 30 meter cable, as described above, coupled to it, depending on its placement within the aircraft. The cable 76 is preferably coupled between a zone bridge unit and the active disconnect 72. The zone bridge unit controls communications to and from one or more seat entertainment units, through which a passenger has access to the in-flight entertainment system. Preferably, the ports 78 and 82, which are positioned in front of the wall 70, will have a 4.5 meter cable, as described above, coupled to them. The cables 80 and 84 are preferably coupled between the active disconnect 72 and seat entertainment units within the cabin of the aircraft. Because of the smaller diameter of the 4.5 meter cable, such a cable is easier to adapt and incorporate within the cabin of the aircraft. Specifically, within the cabin of an aircraft cables running to the seats, must be hidden from view for both aesthetic and safety reasons. The smaller diameter 4.5 meter cable will fit into the existing seat tracks of conventional airplanes. However, a larger diameter cable, such as the 20 meter or 30 meter cable, would require modification of the seat tracks on the airplane.

Figure 13:
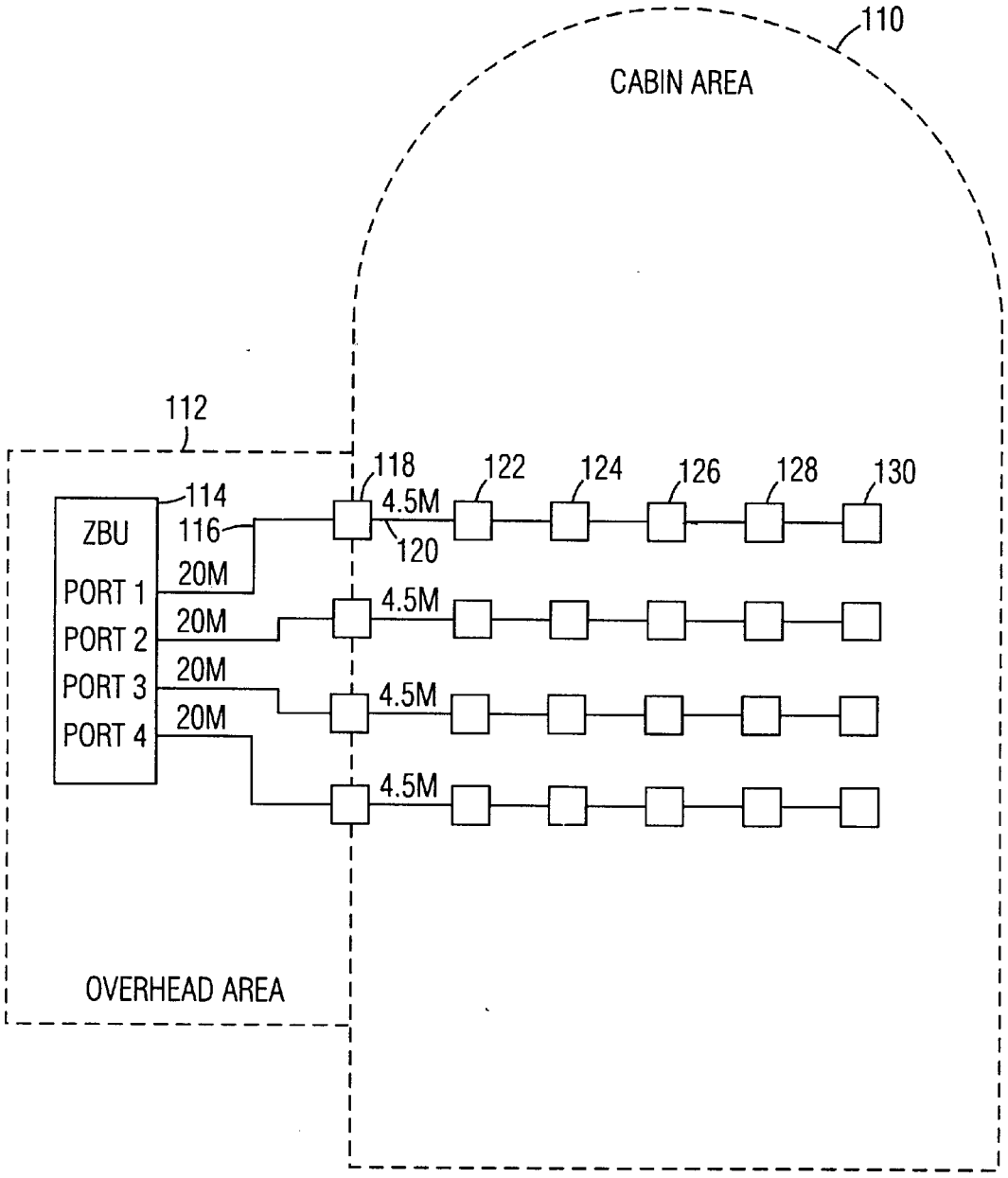
FIG. 13 illustrates a block diagram of a zone within an in-flight entertainment system.

An illustrative block diagram of a configuration of the in-flight entertainment system, within a zone, is shown in FIG. 13. A zone bridge unit 114 is included within the overhead areas of the aircraft. The zone bridge unit 114 includes four ports. For illustration purposes, only the connections from the first port of the zone bridge unit 114 will be discussed. It should be readily understood, that the remaining ports of the zone bridge unit 114 will include similar configurations. It should also be readily understood that other zone bridge units within the system will also include similar configurations.

A 20 meter IEEE 1394 cable 116 is coupled between the first port of the zone bridge unit 114 and an active disconnect 118, mounted within a bulkhead of the aircraft. Within the cabin area 110, a 4.5 meter IEEE 1394 cable 20 is coupled between the active disconnect 118 and a seat electronics unit 122. The seat electronics unit 122 is then coupled to the seat electronics unit 124 by a 4.5 meter IEEE 1394 cable. The seat electronics unit 124 is coupled to the seat electronics unit 126 by a 4.5 meter IEEE 1394 cable. The seat electronics unit 126 is coupled to the seat electronics unit 128 by a 4.5 meter IEEE 1394 cable. The seat electronics unit 128 is coupled to the seat electronics unit 130 by a 4.5 meter IEEE 1394 cable.

Use of the active disconnect 118 allows a larger diameter cable 116 to be used behind the aircraft's bulkhead, in the overhead area, where the distances between active IEEE 1394 devices are greater and there is more room for larger diameter cables, while the smaller diameter cables 120 are used in the cabin area of the aircraft, where the smaller size cable is necessary to adapt the cable into the cabin surroundings. Without the active disconnect 118, a larger diameter cable would be used to connect devices behind the bulkhead with the seat entertainment units in the cabin, requiring modification of at least the seat tracks in the cabin. Alternatively, the IEEE 1394 devices could be no more than 4.5 meters apart, but this reduced flexibility is bad for many aircraft configurations. The active disconnect 118 also allows flexibility in the configuration of the seat entertainment units within the cabin, allowing cables to be coupled to or removed from the ports of the zone bridge unit 114 at any time. This flexible configurability is a distinct advantage when an airline decides to change the configuration of the seats. Thus, seat entertainment units can be easily added to or removed from the IEEE 1394 serial bus, through the active disconnects. If the active disconnect includes multiple ports in the cabin area, as does the active disconnect 72 of FIG. 5, then one of the ports 78 and 82 can also be used as a hot standby port in the event that the other port is not operational.

A detailed block diagram of the components within the preferred physical connection circuit 86 is illustrated in FIG. 6. It should also be understood that alternatively, many minor alterations within this circuit are available to those skilled in the art. A three-port IEEE 1394 physical connection integrated circuit 90 is coupled to the ports 74, 78 and 82, for receiving and transmitting signals through the ports 74, 78 and 82. The integrated circuit 90 is preferably an IBM 21S750. Alternatively, the integrated circuit 90 is a TI TSB12LV03.

The integrated circuit 90 is a three port circuit which provides the physical layer for the IEEE 1394 node. An oscillator 92 and a driver circuit 94 are used to provide a clock reference signal to the integrated circuit 90. Pin 7 of the oscillator 92 is coupled to ground. Pin 14 of the oscillator 92 is coupled to receive +5 volts and to a first terminal of a capacitor C19. A second terminal of the capacitor C19 is coupled to ground. Pin 8 of the oscillator 92 preferably provides a clock reference signal having a frequency equal to 24.578 MHz, and is coupled to pin 2 of the driver circuit 94. Pins 3–9 and 16 of the driver circuit 94 are coupled to ground. Pin 19 of the driver circuit 94 is coupled to ground and to a first terminal of a capacitor C20. A second terminal of the capacitor C20 is coupled to a first terminal of a resistor R20 and to the digital voltage supply DVDD. A second terminal of the resistor R20 is coupled to pin 1 of the driver circuit 94. Pin 20 of the driver circuit 94 is coupled to the digital voltage supply DVDD. Pin 18 provides the output of the driver circuit 94 and is coupled to pin 34 of the integrated circuit 90 for providing the clock reference signal to the integrated circuit 90.

The pins 45, 56 and 42 of the integrated circuit 90 are coupled to a first terminal of a resistor R2. A second terminal of the resistor R2 is coupled to ground. A first terminal of a resistor R3 is coupled to the digital voltage supply DVDD. A second terminal of the resistor R3 is coupled to a first terminal of a capacitor C1 and to the pin 58 of the integrated circuit 90. A second terminal of the capacitor C1 is coupled to ground. The pins 43, 57, 38, 61 and 35 are all coupled to ground. The analog ground AGND pins 10, 19, 25 and 62 are all coupled to ground. The phase-lock loop (PLL) analog ground AGND(PLL) pins 27 and 30 are all coupled to ground. The digital ground DGND pins 1, 16, 17, 32, 33, 36, 48, 49, 52, 60 and 64 are all also coupled to ground.

The analog power pins 11, 18, 21, 24 and 63 are coupled together and to the analog voltage supply AVDD. The analog power pin 11 is coupled to a first terminal of a capacitor C2. The analog power pin 18 is coupled to a first terminal of a capacitor C3. The analog power pin 21 is coupled to a first terminal of a capacitor C4. The analog power pin 24 is coupled to a first terminal of a capacitor C5. The analog power pin 63 is coupled to a first terminal of a capacitor C6.

The PLL analog power pins 26 and 31 of the integrated circuit 90 are coupled together and to the PLL power signal PVDD. The PLL analog power pin 26 is coupled to a first terminal of a capacitor C7. The PLL analog power pin 31 is coupled to a first terminal of a capacitor C8. The digital power pins 37 and 59 are coupled together and to the digital power signal DVDD. The digital power pin 37 is coupled to a first terminal of a capacitor C9. The digital power pin 59 is coupled to a first terminal of a capacitor C10. Second terminals of the capacitors C2, C3, C4, C5, C6, C7, C8, C9 and C10 are all coupled together and to ground.

The differential signals TPA and TPB for a first port are coupled to pins 2, 3, 4 and 5 of the integrated circuit 90. The differential signals TPA and TPB for a second port are coupled to pins 6, 7, 8 and 9 of the integrated circuit 90. The differential signals TPA and TPB for a third port are coupled to pins 12, 13, 14 and 15 of the integrated circuit 90.

The positive differential signal TPA1 from port 1 is coupled to pin 2 of the integrated circuit 90 and to a first terminal of a resistor R4. The negative differential signal $\overline{\text{TPA1}}$ from port 1 is coupled to pin 3 and to a first terminal of the resistor R5. A second terminal of the resistor R4 is coupled to a second terminal of the resistor R5, to a first terminal of a capacitor C11, to a first terminal of a capacitor C16 and to pin 20 of the integrated circuit 90. Second terminals of the capacitors C11 and C16 are both coupled to ground.

The positive differential signal TPB1 from port 1 is coupled to pin 5 of the integrated circuit 90 and to a first terminal of a resistor R6. The negative differential signal $\overline{\text{TPB1}}$ from port 1 is coupled to pin 4 and to a first terminal of a resistor R7. A second terminal of the resistor R6 is coupled to the second terminal of the resistor R7, to a first terminal of a resistor R8 and to a first terminal of a capacitor C12. A second terminal of the resistor R8 is coupled to a second terminal of the capacitor C12 and to ground.

The positive differential signal TPA2 from port 2 is coupled to pin 6 of the integrated circuit 90 and to a first terminal of a resistor R9. The negative differential signal $\overline{\text{TPA2}}$ from port 2 is coupled to pin 7 and to a first terminal of a resistor R10. A second terminal of the resistor R9 is coupled to a second terminal of the resistor R10, to a first terminal of a capacitor C13, to the first terminal of the capacitor C16 and to the pin 20 of the integrated circuit 90. A second terminal of the capacitor C13 is coupled to ground.

The positive differential signal TPB2 from port 2 is coupled to pin 9 of the integrated circuit 90 and to a first terminal of a resistor R11. The negative differential signal $\overline{\text{TPB2}}$ from port 2 is coupled to pin 8 and to a first terminal of a resistor RI 2. A second terminal of the resistor R11 is coupled to a second terminal of the resistor R12, to a first terminal of a resistor R13 and to a first terminal of a capacitor C14. A second terminal of the resistor R13 is coupled to a second terminal of the capacitor C14 and to ground.

The positive differential signal TPA3 from port 3 is coupled to pin 12 of the integrated circuit 90 and to a first terminal of a resistor R19. The negative differential signal $\overline{\text{TPA3}}$ from port 3 is coupled to pin 13 and to a first terminal of a resistor R18. A second terminal of the resistor R18 is coupled to a second terminal of the resistor R19 and to a first terminal of a capacitor C18. A second terminal of the capacitor C18 is coupled to ground.

The positive differential signal TPB3 from port 3 is coupled to pin 15 of the integrated circuit 90 and to a first terminal of the resistor R16. The negative differential signal $\overline{\text{TPB3}}$ from port 3 is coupled to pin 14 and to a first terminal of a resistor R15. A second terminal of the resistor R15 is coupled to a second terminal of the resistor R16, to a first terminal of a resistor R17 and to a first terminal of a capacitor C17. A second terminal of the resistor R17 is coupled to a second terminal of the capacitor C17 and to ground.

An external PLL filter input FC0 at pin 28 of the integrated circuit 90 is coupled to a first terminal of a capacitor C15. A second terminal of the capacitor C15 is coupled to an external PLL filter input FC1 at pin 29. An external current setting resistor input R0 at pin 22 is coupled to a first terminal of a resistor R14. A second terminal of the resistor R14 is coupled to an external current setting resistor input R1 at pin 23.

With the inclusion of the integrated circuit 90, a physical layer is provided for the IEEE 1394 node, formed by the active wall disconnect 72. Through the preferred embodiment of the active wall disconnect 72, three IEEE 1394 ports are available, each for coupling to an IEEE 1394 cable.

Figure 7A:
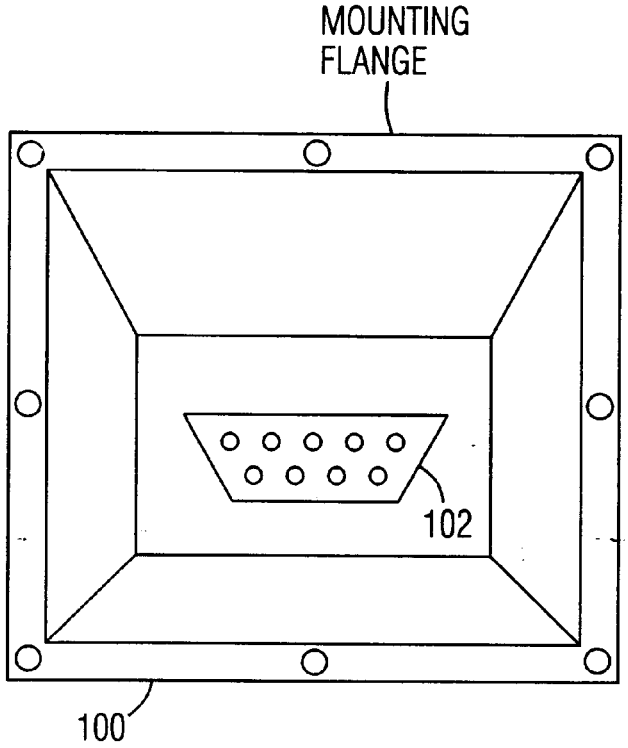
FIG. 7A illustrates a front view of a mounting flange of a two-port active disconnect of the present invention for mounting within an aircraft bulkhead.
Figure 7B:
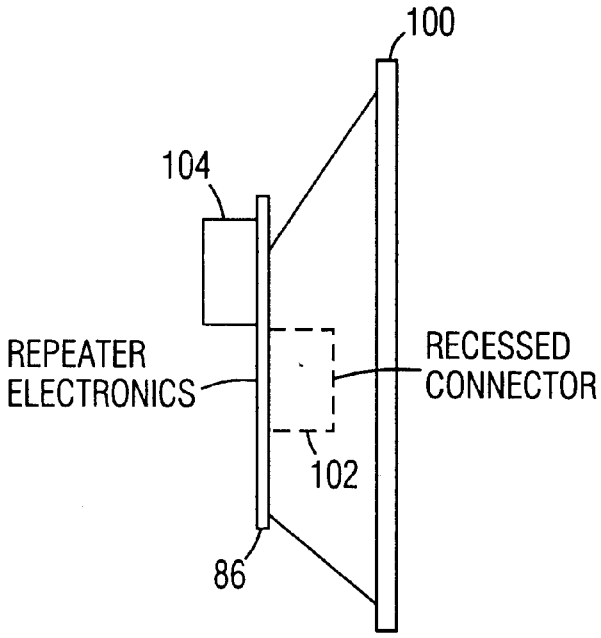
FIG. 7B illustrates a side view of the mounting flange of FIG. 7A.

A front view of a mounting flange of an alternate embodiment of the active disconnect of the present invention is illustrated in FIG. 7A. The mounting flange 100 is recessed in the wall and includes a single connector port 102. The connector port 102 illustrated is a standard nine-pin connector, however, only six of the pins are used to connect an IEEE 1394 cable. Other sufficiently rugged and capable connectors could be substituted for the connector port 102. A side view of the mounting flange 100 is illustrated in FIG. 7B. The connector port 102 is coupled to the physical connection circuit 86. A connector port 104 is coupled to the physical connection circuit 86 and is mounted to the mounting flange 100 behind a wall. While, this alternate embodiment has been illustrated with one connector port in front of the wall and one connector port behind the wall, and the preferred embodiment of the wall disconnect of the present invention has been illustrated with two connector ports in front of the wall and one connector port behind the wall, it should be apparent that any appropriate number of connector ports could be included both in front of and behind the wall. Specifically, two or more connector ports can be included behind the wall, for cables running between active wall disconnects.

The preferred embodiment of the active disconnect of the present invention has been described above for use within an aircraft. It should also be apparent that the active disconnect can be used in many other environments. For example, active disconnects can be included within walls of a building such as a home, office, computer center, school and hospital, to couple IEEE 1394 cables running behind the walls, thereby forming an IEEE 1394 serial bus to which IEEE 1394 devices can be coupled throughout the building. Active disconnects can also be included for use in other transportation modes such as trains, busses, ferries and cruise ships.

The present invention has been described in terms of specific embodiments incorporating details to facilitate the understanding of principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

We claim:

1. An IEEE 1394 standard compliant cable having a length greater than 4.5 meters comprising:

a. a first twisted pair of wires for carrying a first differential signal, wherein the first twisted pair of wires comprise a wire of a diameter of at least 26 American Wire Gauge;

b. a first internal braided shield formed around the first twisted pair of wires for reducing EMI emissions from the first twisted pair;

c. a second twisted pair of wires for carrying a second differential signal, wherein the second twisted pair of wires comprise a wire of a diameter of at least 26 American Wire Gauge;

d. a second internal braided shield formed around the second twisted pair of wires for reducing EMI emissions from the second twisted pair;

e. a plurality of power conductors for carrying power signals;

f. an overall braided shield formed around the power conductors and the first and second internal braided shields; and g. a flame retardant jacket formed around the overall braided shield.

2. The IEEE 1394 cable as claimed in claim 1 further comprising a first connector at a first end of the cable and a second connector at a second end of the cable, the first and second connectors each including a first and second pin coupled to the first twisted pair of wires, a third and fourth pin coupled to the second twisted pair of wires and a fifth and sixth pin coupled to the plurality of power conductors.

3. The IEEE 1394 cable as claimed in claim 2 wherein both the first and second internal braided shields are aluminum/polyester film braided shields and further comprise insulating tape.

4. The IEEE 1394 cable as claimed in claim 3 wherein the insulating tape is PTFE tape.

5. The IEEE 1394 cable as claimed in claim 3 wherein the overall braided shield is aluminum/polyester film.

6. The IEEE 1394 cable as claimed in claim 5 wherein the flame retardant jacket is polyurethane.

7. An IEEE 1394 standard compliant cable having a length greater than 4.5 meters for coupling together two IEEE 1394 nodes, comprising:

a. a first shielded twisted pair of wires for carrying a first differential signal, wherein the first twisted pair of wires comprise a wire of a diameter of at least 26 American Wire Gauge;

b. a second shielded twisted pair of wires for carrying a second differential signal, wherein the second twisted pair of wires comprise a wire of a diameter of at least 26 American Wire Gauge; and c. a plurality of power conductors for carrying power signals.

8. The IEEE 1394 cable as claimed in claim 7 further comprising a first connector at a first end of the cable and a second connector at a second end of the cable, the first and second connectors each including a first and second pin coupled to the first twisted pair of wires, a third and fourth pin coupled to the second twisted pair of wires and a fifth and sixth pin coupled to the plurality of power conductors.

9. The IEEE 1394 cable as claimed in claim 8 further comprising:

a. a first internal braided shield formed around the first twisted pair of wires for reducing EMI emissions from the first twisted pair;

b. a second internal braided shield formed around the second twisted pair of wires for reducing EMI emissions from the second twisted pair;

c. an overall braided shield formed around the power conductors and the first and second internal braided shields; and d. a flame retardant jacket formed around the overall braided shield.

10. An IEEE 1394 standard compliant cable having a length of at least 20 meters comprising:

a. a first twisted pair of wires for carrying a first differential signal, wherein the first twisted pair of wires comprise a wire of a diameter of at least 18 American Wire Gauge;

b. a first internal braided shield formed around the first twisted pair of wires for reducing EMI emissions from the first twisted pair;

c. a second twisted pair of wires for carrying a second differential signal, wherein the second twisted pair of wires comprise a wire of a diameter of at least 18 American Wire Gauge;

d. a second internal braided shield formed around the second twisted pair of wires for reducing EMI emissions from the second twisted pair;

e. a plurality of power conductors for carrying power signals;

f. an overall braided shield formed around the power conductors and the first and second internal braided shields; and g. a flame retardant jacket formed around the overall braided shield.

11. The IEEE 1394 cable as claimed in claim 10 further comprising a first connector at a first end of the cable and a second connector at a second end of the cable, the first and second connectors each including a first and second pin coupled to the first twisted pair of wires, a third and fourth pin coupled to the second twisted pair of wires and a fifth and sixth pin coupled to the plurality of power conductors.

12. The IEEE 1394 cable as claimed in claim 11 wherein both the first and second internal braided shields are aluminum/polyester film braided shields and further comprise insulating tape.

13. The IEEE 1394 cable as claimed in claim 12 wherein the insulating tape is PTFE tape.

14. The IEEE 1394 cable as claimed in claim 12 wherein the overall braided shield is aluminum/polyester film.

15. The IEEE 1394 cable as claimed in claim 14 wherein the flame retardant jacket is polyurethane.

16. An IEEE 1394 standard compliant cable having a length of at least 30 meters comprising:

a. a first twisted pair of wires for carrying a first differential signal, wherein the first twisted pair of wires comprise a wire of a diameter of at least 16 American Wire Gauge;

b. a first internal braided shield formed around the first twisted pair of wires for reducing EMI emissions from the first twisted pair;

c. a second twisted pair of wires for carrying a second differential signal, wherein the second twisted pair of wires comprise a wire of a diameter of at least 16 American Wire Gauge;

d. a second internal braided shield formed around the second twisted pair of wires for reducing EMI emissions from the second twisted pair;

e. a plurality of power conductors for carrying power signals;

f. an overall braided shield formed around the power conductors and the first and second internal braided shields; and g. a flame retardant jacket formed around the overall braided shield.

* * * * *

UNITED STATES PATENT AND TRADEMARK OFFICE

CERTIFICATE OF CORRECTION

PATENT NO. : 5,945,631

DATED : August 31, 1999

INVENTOR(S) : Gregory K. Henrikson *et al.*

It is certified that error appears in the above-identified patent and that said Letters Patent is hereby correct as shown below:

On the Title Page:

Item [56] References Cited - U.S. PATENT DOCUMENTS

Insert --

| | | | |
|---|---|---|---|
| 2,386,753 | 10/1945 | Shield | 174/36 |
| 2,603,684 | 07/1952 | Holmes | 174/106 |
| 3,785,432 | 01/1974 | Kabat et al. | 165/22 |
| 4,376,920 | 03/1983 | Smith | 333/12 |
| 4,822,304 | 04/1989 | Herron | 439/610 |
| 4,871,883 | 10/1989 | Guiol | 174/36 |
| 5,162,609 | 11/1992 | Adriaenssens et al. | 174/34 |
| 5,244,415 | 09/1993 | Marsilio et al. | 439/610 |
| 5,483,656 | 01/1996 | Oprescu et al. | 395/750 |
| 5,493,657 | 02/1996 | Van Brunt et al. | 395/308 |
| 5,504,757 | 04/1996 | Cook et al. | 370/84-- |

Item [56] References Cited - OTHER PUBLICATIONS

Insert --Craig Theorin, "High Speed Serial Links Benefit From Advanced Cabling," EDN Access, October 26, 1995.

Tensolite Company, product specification, part no. 20470/9J207X-4(LD).

Tensolite Company, product specification, part no. 18480/9J207X-4(LD).

Tensolite Company, product specification, part no. 24443/9B048X-4(LD), 6/3/93.

Tensolite Company, product specification, part no. 24443/9C062X-4(LD), 3/17/93.

Raychem Corporation, specification control drawing, part no. EPD-RWC-13458, 8/7/95.

Raychem specification control drawing, part no. 82A0111, p. 1, 9/10/95.--

UNITED STATES PATENT AND TRADEMARK OFFICE

CERTIFICATE OF CORRECTION

PATENT NO. : 5,945,631

DATED : August 31, 1999

INVENTOR(S) : Gregory K. Henrikson *et al.*

It is certified that error appears in the above-identified patent and that said Letters Patent is hereby correct as shown below:

In Col. 8, line 51, replace "24" with --74-- between "port" and "from"; and on line 64, replace "72," with --74,-- between "ports" and "78".

In Col. 9, line 32, replace "20" with --120-- between "cable" and "is coupled".

In Col. 11, line 36, replace "RI 2." with --R12.-- between "resistor" and "A second".

Signed and Sealed this

Second Day of May, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,945,631
DATED : August 31, 1999
INVENTOR(S) : Henrikson et al.

It is certified that error appears in the above-identified patent and that said Letters Patent is hereby corrected as shown below:

On the title page, item [73], should read - - Sony Trans Com Inc., Irvine, Calif. - - .

Signed and Sealed this

Fifth Day of September, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,945,631

DATED : August 31, 1999

INVENTOR(S) : Gregory K. Henrikson et al.

It is certified that error appears in the above-identified patent and that said Letters Patent is hereby correct as shown below:

On the title page, item "[73] Assignees:" replace "Sony Electronics, Inc., Park Ridge, N.J." with --Sony Trans Com Inc., Irvine, Calif.--

Signed and Sealed this

Nineteenth Day of September, 2000

*Attest:*

Q. TODD DICKINSON

*Attesting Officer*

*Director of Patents and Trademarks*